US005362059A

United States Patent [19]

Grossman

[11] Patent Number: 5,362,059

[45] Date of Patent: Nov. 8, 1994

[54] GOLF SWING TRAINING AND EXERCISE APPARATUS

[76] Inventor: Michael R. Grossman, 8120 E. San Miguel, Scottsdale, Ariz. 85250

[21] Appl. No.: 187,304

[22] Filed: Jan. 26, 1994

[51] Int. Cl.[5] ..... A63B 69/36

[52] U.S. Cl. ..... 273/186.2; 273/193 A; 482/109; 482/111

[58] Field of Search ..... 273/186.2, 193 R, 193 A, 273/193 B, 194 R, 194 A, 194 B, 35 R; 482/109, 111

[56] References Cited

U.S. PATENT DOCUMENTS

| | | | |
|---|---|---|---|
| 3,416,803 | 12/1968 | Batista | 482/109 X |
| 3,565,444 | 2/1971 | La Rocca | 273/186 |
| 3,606,340 | 9/1971 | Tiller | 273/186 A |
| 4,576,378 | 3/1986 | Backus | 273/186 A |
| 4,603,854 | 8/1986 | Krausz | 482/111 |
| 5,100,148 | 3/1992 | Smith | 273/186 A |
| 5,165,683 | 11/1992 | Beutler et al. | 273/35 R |
| 5,184,825 | 2/1993 | Ruth | 273/186.2 |
| 5,207,625 | 5/1993 | White | 273/193 A X |
| 5,236,192 | 8/1993 | Pitzel | 482/111 X |

*Primary Examiner*—George J. Marlo

*Attorney, Agent, or Firm*—Donald J. Lisa; Steven Lin

[57] ABSTRACT

A swing training and exercise apparatus used by a swinger for practicing and exercising swing motions. The swing training apparatus has a tubular, generally rectangular framework (10). A first handle (30) is on the inboard end (11*a*) of the upper member 11 of the framework (10), and an end of a second handle (40) is attached at an obtuse angle to framework (10) between the horizontal upper member (11) and a vertical inboard member (13) of framework (10). The area enclosed by the framework (10) is covered by an air resistant material (20) attached thereto for providing drag that opposes the swing motion. The amount of drag is dependent on the material chosen, the percentage of the enclosed area covered by air resistant material (20), and the aspect ratio of the plane of the framework (10) and material (20) to the path of the swing enabling the swinger to practice and build up muscles and muscle memory needed to effect a good, proper swing. The large size of the framework (10) and the visible portions of material (20) provide a strong visual cue to the proper positioning of the framework during the swing motion. The apparatus is foldable for easy storage.

19 Claims, 2 Drawing Sheets

GOLF SWING TRAINING AND EXERCISE APPARATUS

BACKGROUND OF THE INVENTION

1. Fields of the Invention

The present invention relates generally to a device for swing training and exercise, and, more particularly, to a transportable, foldable golf swing device which presents visual positioning cues and provides muscle development during swing practice.

2. Discussion of Background and Prior Art

Many types of devices have been designed and made for training and exercising swing motions required in an athletic or sport activity. These devices help athletes or sportsmen to learn, practice, and improve their swings. These swing training devices help the user to train and build up muscles and muscle memory needed to effect a good, proper swing.

a. Visible Drag Swing Training Devices

Various sports require the swinging of a particular sports equipment (i.e. golf club, tennis racquet, baseball bat, etc.). The swing motion used in such sports generally includes: 1) the back-swing; 2) the down-swing or power-side area (i.e. hitting area); and 3) the up-swing or follow-through area. While mastering all aspects of the swing are critical to a stellar performance, the main part of a swing is the down-swing or power stroke since it unleashes the hitting power and develops the greatest speed in the swing motion. The least amount of air-resistant force or aerodynamic drag and required muscle strength and coordination is generally experienced during the back-swing and the follow-through. Therefore, it is generally desired that a swing training device be designed so that a user experiences the most amount of drag during a down-swing and the least amount of drag during a back-swing or up-swing thereby more closely simulating the forces felt and required in an actual swing. During training and exercise with any device, a user would want to experience this larger amount of resistance during the down-swing in order to develop and build up those muscles needed for an effective swing.

One such prior art device to Beutler (U.S. Pat. No. 5,165,683) teaches a method and apparatus for training a swinger to develop the proper motions and muscles needed to effect a good golf swing. The apparatus has a set of foldable blades mounted to a shaft handle. The blades are folded closed (hanging down) at the start of the back-swing, unfold open at the top of the back-swing, and purport to remain in that position throughout the down-swing and follow-through providing constant drag throughout the entire swing. This device fails to accurately simulate a golf swing which does not require constant muscle forces throughout the swing. Moreover, among other deficiencies, due to the cumbersome rotational means in the shaft and grip, this device is not likely to maintain the open blades perpendicular to the path of the swing even if the blades open as described and, therefore, could not provide accurate visual cues to enable the swinger to adjust a defective swing.

Thus, there is a long felt need for an effective variable drag golf swing training device, and, moreover, for a golf swing muscle building device that will readily accommodate different levels of drag suited to the different strength levels of people, i.e., providing high drag versions for men and low drag embodiments for women and children.

b. Visual Cues During A Sports Swing

Another problem faced by most sportsmen, such as golfers, in training and exercising swing motions for various sports is that they lack the ability to visualize and see themselves when they are swinging a particular sports equipment. Without this visualization, sportsmen cannot easily identify the problems and errors encountered in their swings and swing motions by themselves and they, therefore, are not able to make appropriate adjustments that would enable them to effect a good, proper swing.

Typical prior art swing training devices, particularly golf swing devices, do not provide any means, much less an effective means, for visualizing the problems encountered during the swing which would guide the sportsman in making corrections to develop an effective, proper swing. Most prior swing training devices that do attempt to provide some visual cue to the swinger are too small to provide an effective cue. Those prior devices that are large enough to provide a good visual cue are subject to a variety of problems including too cumbersome, too expensive, having to attach to a golf club itself and becoming easily misaligned, and not being readily transportable for use, such as, in a suitcase during an overnight business trip to be used for practice in the hotel room.

Therefore, there is a long felt need for a swing training device providing the sportsman with a visual aid for guiding and training himself to position and swing a particular sports equipment effectively and which is easily handled, inexpensive and transportable.

Therefore, in overcoming the problems and limitations of the prior art, it is an object of the present invention to provide an apparatus used for swing training and exercising which provides a maximum amount of air resistance during a down-swing and a minimal amount of air resistance during the back-swing and up-swing of a swing motion to realistically simulate the muscle forces felt in an actual golf swing.

It is another object of this invention to provide a swing training device that provides a strong visual aid to a sportsman especially during the down-swing or proper stroke for guiding and training himself to effect a good, proper swing motion.

It is a further object of this invention to provide a swing training device that trains and builds up a swinger's muscles needed for a good, proper swing motion.

It is still a further object of this invention to provide a swing training device that is easily handled, inexpensive, foldable and readily transportable.

It is also an object of the present invention to provide a swing training device that may be readily available in a variety of forms which vary in the amount of drag provided by the swing training device to accommodate different physical requirements of various users.

SUMMARY OF THE INVENTION

Set forth below is a brief summary of the invention which solves the foregoing problems and achieves the foregoing and other objects, benefits, and advantages in accordance with the purposes of the present invention as embodied and broadly described herein.

One aspect of the invention is a swing training and exercising apparatus used by a swinger for practicing and exercising swing motions during which impact with a ball is simulated including a framework having an upper member portion with inboard and outboard ends and an inboard member portion attached to the upper member portion, a first handle on the inboard end of the upper member portion for being gripped by one hand of the swinger when holding the apparatus in a swinging position, a second handle attached to the framework between the upper and inboard member portions for being gripped by the other hand of the swinger when holding the apparatus in a swinging position, an air-resistant material attached to the framework including the upper and inboard member portions, and in which the framework and material provide a variable amount of drag during movement of the framework in a swing path from one end of a swing motion on one side of a swinger's body to another end of the swing motion on the other side of the body and a strong visual cue to the swinger of the position of the framework relative to the body as the framework passes through the simulated point of impact with the ball while practicing the swing motion.

A further feature of this aspect of the invention includes a generally rectangular tubular framework wherein the second handle is attached to the inboard end of the first handle forming an obtuse angle between the upper member portion and the second handle, and in which an upper edge of the rectangular framework and the portions of the air-resistant material which are visible to the swinger during the swing motion are used by the swinger as a reference for visualizing and maintaining the framework in predetermined positions through the swing motion.

A further feature of this aspect of the invention is that the second handle is lockably, rotatably attached allowing the second handle to be rotated between an unlocked, folded position for storage and a locked, extended position for use.

A still further feature of this aspect of the invention is a pair of disengageable couplings mounted on the framework for enabling the framework to be conveniently assembled and disassembled, or, in the alternative, a pair of lockable hinged couplings mounted to the framework for allowing the framework to be folded for transport or storage.

Another feature of this aspect of the invention provides various means for varying the amount of drag experience in effecting a proper swing.

DETAILED DESCRIPTION OF THE INVENTION

Figure 1:
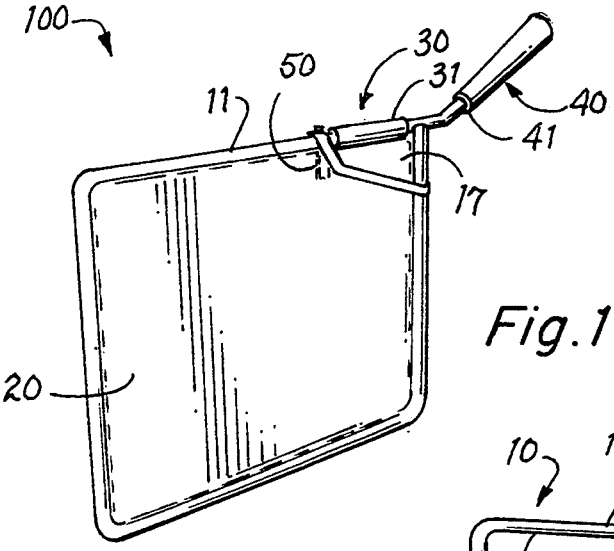
FIG. 1—Perspective view of the preferred embodiment of the swing training and exercising apparatus.
Figure 6:
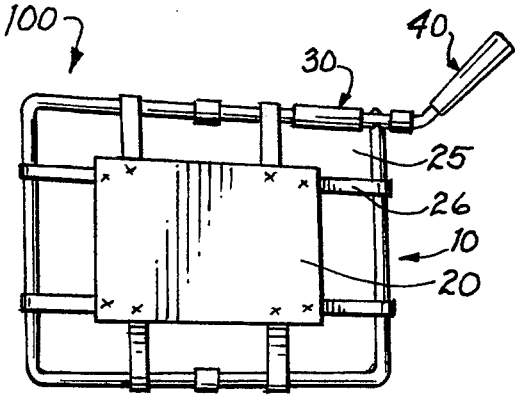
FIG. 6—Side elevation view of a second embodiment swing training and exercising apparatus having a plurality of openings adjacent the inner perimeter of the framework of the apparatus.
Figure 7:
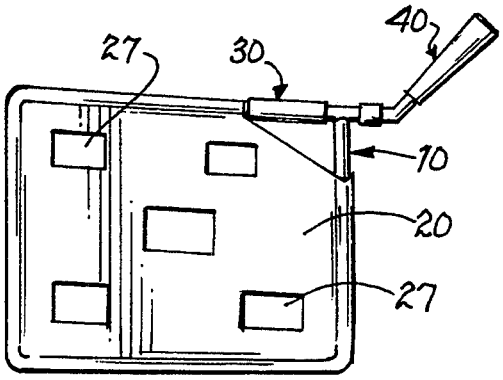
FIG. 7—Side elevation view of a third embodiment swing training and exercising apparatus having a plurality of openings located throughout the surface of the air resistant material.

FIGS. 1, 6 and 7 show various embodiments of the present invention swing training and exercise apparatus. These embodiments have unique features and advantages that allow it to overcome the limitations and problems of prior art swing training devices. These embodiments and their unique features and advantages are now described in more detail.

1. The Preferred Embodiment

FIG. 1 shows a swing training and exercising apparatus 100 that is used by a swinger (i.e. a sportsman or athlete) for practicing and exercising various swing motions. The swing training apparatus 100 has four main components: a generally rectangular framework 10 for providing visual aid to the swinger in practicing and observing his swing motion, a first handle 30 located on the framework 10 that is grasped by one hand of the swinger when holding the apparatus in a swinging position, a second handle 40 attached to the framework 10 that is grasped by the other hand of the swinger when holding the apparatus in a swinging position, and an air resistant material 20 attached to the framework 10 for providing aerodynamic resistance or drag during the swing motion. Each of these components are now described in more detail.

2. The Framework

Figure 2A:
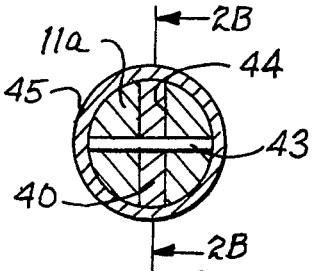
FIG. 2A—Sectional view along the lines 2A—2A of FIG. 2.
Figure 2C:
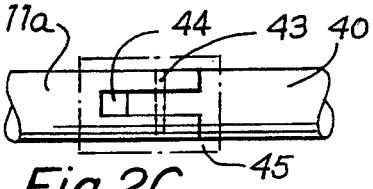
FIG. 2C—Enlarged top plan view of coupling 42 of FIG. 2.
Figure 2B:
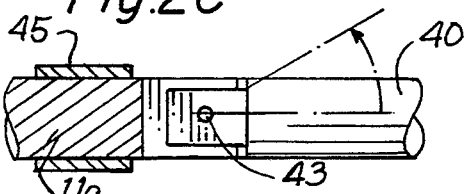
FIG. 2B—Enlarged side plan view in partial section of coupling 42 of FIG. 2.
Figure 2:
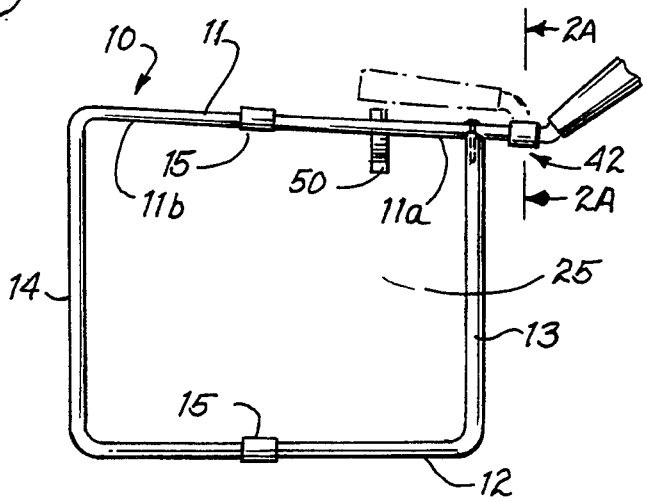
FIG. 2—Side elevation view (as held by the user) of the framework of the preferred embodiment swing training and exercising apparatus.

Referring to FIG. 2, the assembly of the swing training apparatus 100 begins with providing a large framework 10 the upper edge of which is plainly visible to the swinger and functions as a visual aid while practicing and observing his own swing motion. Framework 10, preferably is a large generally rectangular framework about 1.5 feet square having horizontal members 11, 12 and vertical members 13, 14 (FIG. 2). Member 11 has inboard and outboard portions **11*a*, 11*b* respectively, as held by the swinger. Vertical member portion 13 is also inboard with reference to the swinger. Due to the size of the frame and the fact that the silhouette of top edge of the upper member 11 is a straight line extending 1.5 feet perpendicular to the swing path at the simulated point of impact with a golf ball in a golf swing, the swinger gets a strong visual cue of the position of the apparatus 100** during the practicing and observing of his swing motion. As a result, the swinger may observe problems with his swing and make adjustments during subsequent practice swings to develop muscle memory.

Framework 10 is preferably made from a tubular PVC material, but any other type of light weight material (i.e. copper and aluminum tubes or bars, etc.) may also be used for the framework construction. Tubular material is preferred because it is lighter than solid bars and is strong due to its round construction. PVC tubing material, moreover, has the further advantage of being inexpensive.

Framework 10 also functions as the frame for swing training apparatus 100, and other components of the apparatus 100 are attached to this framework 10.

3. The First Handle

Referring to FIGS. 1 and 2, a first handle 30 is located on the inboard end 11*a* of the upper member 11 of framework 10. This first handle 30 is grasped by one hand of the swinger when holding the apparatus 100 in a proper swinging position. The first handle 30 is a part of the framework tubing 10 and is adapted for being grasped by the swinger's hand around the tubing portion 11*a*. A first grip 31 may be mounted around the first handle 30 to provide the swinger with an effective hand hold on the apparatus 100 when held in a swinging position.

A finger guide tab 50 may also be attached to and depend from upper member 11 at or near the first handle 30. The finger guide tab 50 may be placed within the air resistant material 20 so that it is not physically seen by the swinger. The finger guide tab 50 provides a shoulder against which at least one finger of the swinger's hand is placed assisting the swinger to effect a proper swinging motion and maintain an intended alignment during the swing motion.

4. The Second Handle

Referring to FIGS. 1 and 2, a second handle 40 is attached to framework 10 of apparatus 100 between the upper member portion 11 and the inboard member portion 13. The second handle 40 is also adapted for being gripped by the other hand of the swinger when holding the apparatus 100 in a proper swinging position and grip 41 may be mounted on handle 40 to provide a firm hand hold for swinger's other hand.

Figure 8:
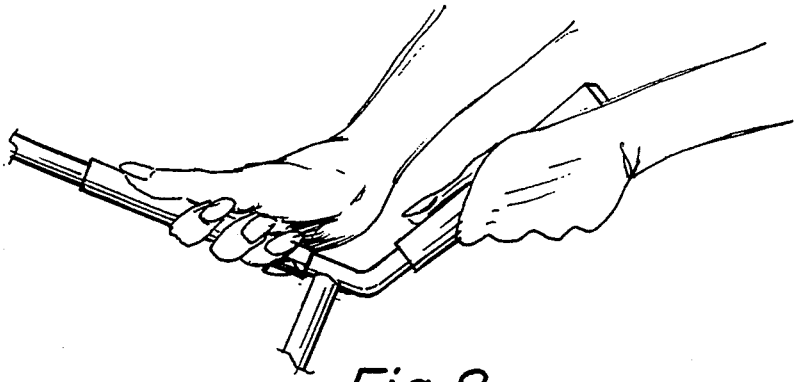
FIG. 8—Side perspective view of the preferred embodiment of the swing training and exercising apparatus showing the wrists of the swinger in a v-shaped position simulating a modified golf grip.
Figure 12:
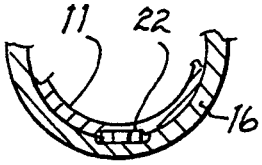
FIG. 12—Sectional view along the line 12—12 of FIG. 11.
Figure 9:
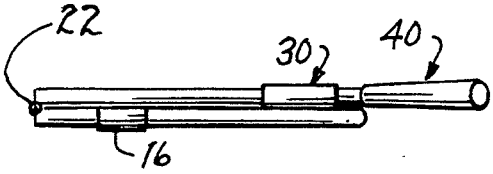
FIG. 9—Top plan view of a folded swing training and exercising apparatus of the embodiment shown in FIGS. 10–12.
Figure 10:
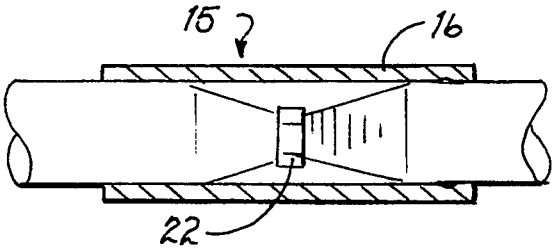
FIGS. 10–11—Enlarged partial side and top sectional views, respectively, of a modified embodiment of the present invention employing a hinged coupling for folding the apparatus.
Figure 13:
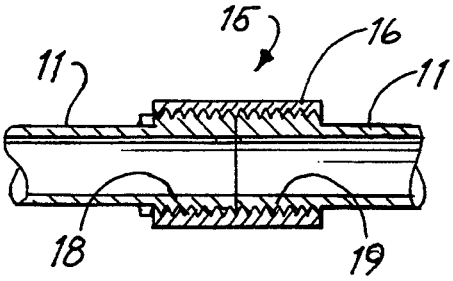
FIG. 13—A partial sectional view of a further modified embodiment of the present invention employing a threaded sleeve type coupling for disassembling the framework.
Figure 11:
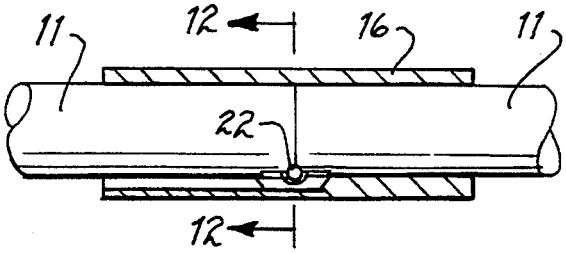

As shown in FIGS. 1 and 2, the second handle 40 is attached to the inboard end of the first handle 30 and forms an obtuse angle between inboard member portion 11 and second handle 40. The angular attachment of the first handle 30 and second handle 40 is a unique feature of this invention. This construction provides the advantage of allowing the swinger to easily grip and firmly hold the apparatus 100 with both hands as seen in FIG. 8. The two handles allow the swinger to properly position his hands, wrists, and arms for effecting a good swing motion. The proper positioning and moving of the hands, wrists, and arms of the swinger is critical to effecting a good swing, by effecting proper release and control of the swing as it is being executed by the swinger and thereby building muscle and muscle memory. The hands and wrist portions closely simulate the positions of these body portions during an actual golf swing. The V-shape positioning of the swinger's wrists in which the fingers of the swinger's hands tend to face upwardly is the position that is desired in effecting a good (i.e. golf) swing. The swinger, therefore, is guided to stabilize his wrists in practicing a swing motion so that good control is effected during a down-swing and up-swing portion of the swing motion.

Second handle 40 may be lockably, rotatably attached to the end portion 11*a* by rotable coupling 42 which allows second handle 40 to be rotated between an unlocked, folded position (shown in dotted lines in FIG. 2) for storage and a locked, extended position (FIG. 2 solid lines) for use. As seen in FIG. 2A, 2B and 2C coupling 42 includes pin 43 rotatably supporting handle 40 in slot 44 in the inboard end of upper member 11*a*, the coupling being held rigid by sleeve 45 which may be moved outboardly to allow handle 40 to be rotated counterclockwise (FIG. 2). The coupling 42 functions to allow second handle 40 to be folded so that it no longer protrudes from framework 10, and coupling 42 also functions to lock handle 40 into place during the use of apparatus 100 by a swinger. Coupling 42, therefore, functions to provide a way to fold second handle 40 so that apparatus 100 may be easily transported or stored.

5. The Air Resistant Material

As shown in FIG. 1, an air resistant material 20 is then attached to the framework 10 including upper member 11 and inboard member 13 in the area enclosed by framework 10 except for an opening 17 to allow the one hand of the swinger to grasp the first handle 30. The air resistant material 20 and framework 10 provide a variable amount of drag during movement of the framework in a swing path from one end of a swing motion on one side of a swinger's body to another end of the swing motion on the other side of the body. The framework 10 and air-resistant material 20 provide an increasing amount of drag during a down-swing from the one end of the swing motion, the drag reaching its maximum at the point of simulated impact with the ball in the front of a swinger's body enabling the swinger to practice and build up muscles needed for effecting the swing motion. In a golf swing, the golfer naturally rolls over his wrists at the point of impact and through the follow-through. The amount of drag, thus, also varies as a function of the aspect ratio of the framework 10 and material 20 presented in a plane perpendicular to the path of the swing motion.

The air resistant material is preferably a rip-stop nylon material, but other types of material that are air resistant may also be used. Rip-stop nylon is made from 100% nylon, and it varies in its tensile strength (weight) in a typical range from 0.005 to 0.009 millimeters. Rip-stop describes the type of weave of the nylon material. Similar types of material have been identified as CORDURA and nylon pack cloth. In any event, any type of material capable of providing a desired amount of drag when presented transverse the path of the swing may be used to make the swing training apparatus 100.

6. The Framework Couplings

Referring to FIGS. 2, 9, 10, 11, 12 and 13, framework 10 of apparatus 100 may also have a pair of disengageable couplings mounted on the framework 10 to enable the framework 10 to be conveniently assembled and disassembled so that the apparatus may be easily transported or stored. The preferred mode, includes threaded sleeve 16 screwed onto threaded ends 18, 19 of members 11, 12 (See, FIG. 13). Alternatively, members 11, 12 may be hinged 22 allowing members 11, 12 to be folded once slideable sleeve 16 is slid away from the joint (FIGS. 9, 10, 11, 12). Alternatively, spring loaded couplings (not shown) which have quick release buttons so that the user of apparatus 100 may push the buttons to quickly release the framework halves and which self lock when released as is known to those skilled in the art may also be used. The apparatus 100 may then be folded in half for easy transportability or storage.

7. Second And Third Embodiments Of Swing Training Apparatus 100

Referring now to FIGS. 6 and 7, a second and third embodiment of swing apparatus 100 are shown. The second embodiment shown in FIG. 6 is similar to the preferred embodiment shown in FIG. 1, but the main difference is that the air resistance material 20 is smaller in size than the surface area enclosed by framework 10. The smaller size air resistant material 20 of FIG. 6 is centrally located within the surface area of framework 10, and it is attached to framework 10 by using attachment means 26. Attachment means 26 may be strips that are affixed around the framework 10 and attached to a receiving means that is attached to the air resistant material 20 wherein said strips and receiving means include interlocking hooks and loops, such as VELCRO fasteners. Since the air resistant material 20 is smaller than the surface area located within framework 10 in this second embodiment, open surface areas 25 exist around the inner perimeter of framework 10. Since the framework 10 encloses an area, the amount of drag provided by the air-resistant material is variable according to the percentage of the enclosed area which is covered by the air resistant material. (The same principle would apply if a slightly pourious air resistant material were used). The size of the air resistant material 20 and, in effect, the size of the open areas 25 determine the drag that is provided by swing training apparatus 100. Therefore, as the size and amount of air resistant material 20 is varied, the drag provided to apparatus 100, in effect, varies as well.

A third embodiment of apparatus 100 is shown in FIG. 7. The third embodiment is virtually identical to the preferred embodiment shown in FIG. 1, but the main difference is that openings 27 exist throughout the surface of air resistant material 27. The number and size of openings 27 are variables that can be changed to vary the amount of drag provided to apparatus 100. Another factor that varies the amount of air resistance provided to either the second embodiment or third embodiment is the type of air resistant material used and the thickness of that material.

It is readily apparent that various types of material 20 may be provided and quickly installed onto framework 10 to accommodate the varying physical requirements of different users such as men, women and children.

8. Using The Swing Training Apparatus 100

Figure 3:
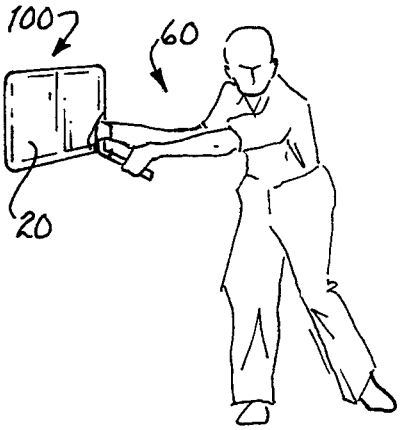
FIG. 3—Front view (facing a right handed user) of a back-swing position of a person swinging the preferred embodiment apparatus.
Figure 4:
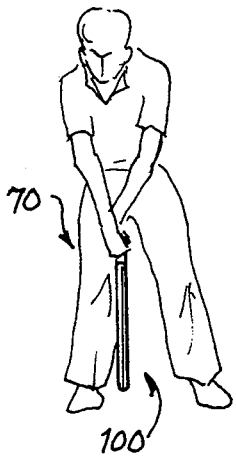
FIG. 4—Front view of a down-swing position of the person in FIG. 3 swinging the preferred embodiment apparatus.
Figure 5:
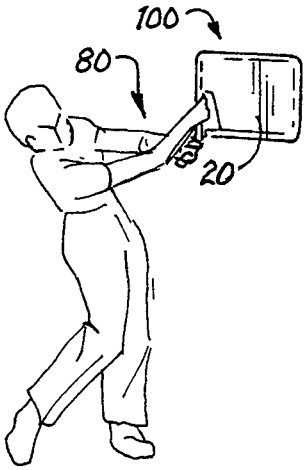
FIG. 5—Front view of an up-swing position of the person in FIG. 3 swinging the preferred embodiment apparatus.

As shown in FIGS. 3–5, the swing training apparatus 100 is used by a swinger in a typical golf swing motion. The swinger first grips the first handle 30 with a first hand and grips the second handle 40 with the other hand. In FIG. 3, the swinger then back swings 60 the apparatus 100 to one side of the body while rotating the hips and shoulders appropriately, keeping the left arm stiff. The swinger using apparatus 100 experiences minimal resistance in the back-swing since the plane of framework 10 and air resistant material 20 is rotated to a position parallel to the path of the swing.

In FIG. 4, the swinger then down-swings 70 the apparatus 100 so that the plane of framework 10 and air resistant material 20 is gradually smoothly rotated perpendicularly to the path of the swing causing drag opposing the direction of the swing, and a maximum amount of air resistance being provided during this portion of the swing. This maximum amount of drag enables the swinger to practice and build up muscles needed for the down-swing portion of a swing motion since the down-swing is a crucial portion of a typical swing.

In FIG. 5, the swinger up-swings 80 the apparatus 100 to the other side of the body so that the swinger's elbows are now criss-crossed from the back-swing position. A minimal amount of air resistance is provided in this up-swing position since the plane of apparatus 100 is again rotated to a position parallel to the path of the swing motion.

During the swing motion the framework 10 and material 20 which are visible to the swinger provide a strong visual cue to the swinger of the position of the framework relative to the body as the framework passes through the simulated point of impact with the ball in front of the body generally squared to the intended path of the ball while practicing the swing motion.

The foregoing description of a preferred embodiment and best mode of the invention known to applicant at the time of filing the application has been presented for the purposes of illustration and description. It is not intended to be exhaustive or to limit the invention to the precise form disclosed, and obviously many modifications and variations are possible in the light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A swing training and exercising apparatus used by a swinger for practicing and exercising swing motions during which impact with a ball is simulated comprising:

a framework having an upper member portion with inboard and outboard ends and an inboard member portion attached to the upper member portion, a first elongated handle on the inboard end of the upper member portion for being gripped by one hand of the swinger when holding the apparatus in a swinging position, a second elongated handle attached to the framework between the upper and inboard member portions and extending outward therefrom for being gripped by the other hand of the swinger when holding the apparatus in a swinging position, an air-resistant material attached to the framework including the upper and inboard member portions, and the framework and material providing a variable amount of drag during movement of the framework in a swing path from one end of a swing motion on one side of a swinger's body to another end of the swing motion on the other side of the swinger's body, and a strong visual cue to the swinger of the position of the framework relative to the swinger's body as the framework passes through the simulated point of impact with the ball while practicing the swing motion.

2. The swing training and exercising apparatus, as claimed in claim 1, wherein the swing motion is a golf swing and includes a backswing beginning from a point in front of the swinger's body to a point on one side of the swinger's body, a down-swing from the one side of the body to the simulated point of impact with the framework generally squared to the intended path of the ball at simulated point of impact in front of the body and a follow-through to the other side of the swinger's body.

3. The swing training and exercising apparatus, as claimed in claim 1, wherein the framework including the upper and inboard member portions is generally rectangular enclosing an area and the air resistant material detachably covers substantially the enclosed area.

4. The swing training and exercising apparatus, as claimed in claim 3, further comprising:

an upper edge of the rectangular framework and the portions of the air-resistant material which are visible to the swinger during the swing motion being used by the swinger as a reference for visualizing and maintaining the framework in predetermined positions through the swing motion.

5. The swing training and exercising apparatus, as claimed in claim 1, wherein the framework is tubular.

6. The swing training and exercising apparatus, as claimed in claim 5, wherein the second handle is tubular.

7. The swing training and exercising apparatus, as claimed in claim 1, wherein the first handle is a framework portion adapted for being grasped by a hand of the swinger.

8. The swing training and exercising apparatus, as claimed in claim 7, further comprising:

a first grip mounted to the first handle, and a second grip mounted to the second handle.

9. The swing training and exercising apparatus, as claimed in claim 1, wherein the second handle is attached to the inboard end of the first handle forming an obtuse angle between the upper member portion and the second handle.

10. The swing training and exercising apparatus, as claimed in claim 9, wherein the second handle is lockably, rotatably attached allowing the second handle to be rotated between an unlocked, folded position for storage and a locked, extended position for use.

11. The swing training and exercising apparatus, as claimed in claim 1, further comprising:

a finger tab depending from the first handle providing a shoulder against which at least one finger of the swinger's hand may be placed for assisting in effecting the swinging motion.

12. The swing training and exercising apparatus, as claimed in claim 1, further comprising:

a pair of disengageable couplings mounted on the framework for enabling the framework to be conveniently assembled and disassembled.

13. The swing training and exercising apparatus, as claimed in claim 1, further comprising:

a pair of lockable hinged couplings mounted to the framework for allowing the framework to be folded for storage.

14. The swing training and exercising apparatus, as claimed in claim 1, wherein the air resistant material is a rip-stop nylon material.

15. The swing training and exercising apparatus, as claimed in claim 1, wherein the framework encloses an area and the amount of drag provided by the air-resistant material is further variable according to the percentage of the enclosed area which is covered by the air resistant material.

16. The swing training and exercising apparatus, as claimed in claim 1, wherein the framework and air-resistant material provide an increasing amount of drag during a down-swing from the one end of the swing motion, the drag reaching its maximum at the point of simulated impact with the ball in the front of a swinger's body enabling the swinger to practice and build up muscles needed for effecting the swing motion.

17. The swing training and exercising apparatus, as claimed in claim 1, wherein the amount of drag varies as a function of the aspect ratio of the framework and material presented in a plane perpendicular to the path of the swing motion.

18. The swing training and exercising apparatus, as claimed in claim 1, further comprising:

the material having an opening adjacent the first handle through which the fingers of the one hand of the swinger are received for grasping the first handle.

19. A swing training and exercising apparatus used by a swinger for practicing and exercising swing motions during which impact with a ball is simulated comprising:

a framework, a first elongated handle having an inboard end, the first handle for being gripped by one hand of the swinger when holding the apparatus in a swinging position, a second elongated handle attached to the inboard end of the first handle and forming an obtuse angle with said first handle for being gripped by the other hand of the swinger when holding the apparatus in a swinging position, the first and second handles attached to the framework, an air-resistant material attached to the framework, and the framework and material providing a variable amount of drag during movement of the framework in a swing path from one end of a swing motion on one side of a swinger's body to another end of the swing motion on the other side of the swinger's body, and a strong visual cue to the swinger of the position of the framework relative to the swinger's body as the framework passes through the simulated point of impact with the ball while practicing the swing motion.

* * * * *